United States Patent [19]

Virgilio et al.

[11] 4,178,781

[45] Dec. 18, 1979

[54] KNITTING NEEDLE

[75] Inventors: Douglas R. Virgilio, Winsted; Robert G. Campbell, Torrington; Alfred J. Fortunato, Torrington; Carl F. Benson, Torrington, all of Conn.

[73] Assignee: The Torrington Company, Torrington, Conn.

[21] Appl. No.: 884,016

[22] Filed: Mar. 6, 1978

[51] Int. Cl.[2] ..... D04B 35/04

[52] U.S. Cl. ..... 66/121

[58] Field of Search ..... 66/123, 121, 119, 120, 66/116, 117; 163/3, 2

[56] References Cited

U.S. PATENT DOCUMENTS

| | | | |
|---|---|---|---|
| 2,685,787 | 8/1954 | Noe | 66/121 |
| 2,854,836 | 10/1958 | Morris | 66/121 |

FOREIGN PATENT DOCUMENTS

| | | | |
|---|---|---|---|
| 1309609 | 3/1973 | United Kingdom | 66/120 |

*Primary Examiner*—Werner H. Schroeder
*Assistant Examiner*—Andrew M. Falik
*Attorney, Agent, or Firm*—Frank S. Troidl

[57] ABSTRACT

The knitting needle is provided with a hook which is so shaped that in lateral cross-section more of the hook wire than usual is located near the inner periphery of the hook bend so as to decrease the maximum stress levels generated in the hook when compared to conventional needle hooks.

5 Claims, 12 Drawing Figures

KNITTING NEEDLE

This invention relates to machine knitting needles. More particularly, this invention is an improved hook of a knitting needle.

A knitted fabric is a series of interlocked loops of yarn. Knitting needles, placed parallel and close together in slots of a knitting machine and activated in longitudinal forward and backward motion by cams, form the fabric.

The needle is provided with a hook to form and hold a new loop of yarn and draw it through previously formed loops. The needle also has a loop-retaining area on the shaft, away from the hook, whereon is retained the loop or several loops of previously knitted yarn. The needle may have a latch pivoted at one end so that the other end of the latch can alternately be pivoted against the top of the hook to close the hook and pivoted in the opposite direction to uncover or open the hook. The loops of yarn as they slide along the reciprocating needle may move the latch to the open and closed positions, or there may be other mechanisms to pivot the latch. The hook-closed position of the latch allows the needle with its newly formed loop on the hook to be drawn through the previously formed loop which slides from the retaining position on the needle shaft and over the closed latch and off the needle. The latch, in its opposite, or open, position permits the loop, or loops, caught by the hook to slide out of the hook and over the open latch onto the loop-retaining portion of the needle shaft. Usually a cam follower or butt is also part of the needle and is actuated by cams to cause the needle to move longitudinally in its slot to perform the knitting function.

In creating the fabric a new loop of yarn laid inside the hook is pulled by the hook through the previously formed loop. During this knitting function the yarn tension on a loop can be considerable, yet the transverse cross-sectional area of the hook is very small, and thus considerable direct tensile stress is developed on the hook wire. The same pull of the yarn on the hook also introduces a bending moment in the hook, giving a resultant additional tensile load on the traverse cross-sectional area of the hook located toward the inner periphery of the hook from the neutral axis. In addition to these two forces, heavy inertial loads are placed upon the hook due to the fact that the needle changes direction backwards and forwards extremely rapidly. This sudden change in direction creates another bending moment in the hook which in one direction of change again adds to the tensile load on the radially inner part of the hook. These three tensile loads at the inside area of the hook bend are all additive and produce the maximum stress at the inside peripheral surface of the hook. Over a period of time this causes even slight marks or discontinuities at or near the inside of the bend to develop into cracks and lead to fatigue failure of the hook. Hooks with greater starting scratches naturally fail even more quickly under these high tensile stresses. Previously, needle hook wire was enlarged in size to strengthen it and give it longer hook life. Once the hook breaks off, obviously, no more loops can be drawn, and damaged fabric is produced. The knitting machine must be stopped and the broken needle must be replaced. Damaged fabric, nonproductive machine time, and mechanical labor are very costly to the producer.

Our invention consists of a machine knitting needle with a hook wire cross-section so shaped as to place substantially more of the hook wire material near the radially inner periphery of the hook at the focus of maximum tensile load than there is with standard known needles, without increasing the hook width or wire lateral cross-sectional area. By getting the maximum number of hook wire fibers as far as possible from the neutral axis of the hook wire toward the interior of the hook bend, by the known laws of mechanics we decrease the stress required in those fibers to resist the bending moment of tensile load. We reshape the wire without increasing the overall lateral width of the hook, thereby maintaining all of the clearances between the needle and other machine elements that were known with the standard needle. We maintain the same radius of hook bend, so there is just as much room for the yarn inside the hook. We maintain the cross-sectional area of the hook wire, thereby not increasing the mass of the wire which would have the detrimental effect of increasing the inertial bending moment in the hook. Indeed, we may even be able to reduce the lateral cross-sectional area of the hook wire with our new shape and still achieve longer fatigue life than with the currently known needles because of our reduced stress levels at the inside surface of the hook. The decrease in the stress level at the hook inside surface, where the maximum stress occurs, obviously increases needle life with all its attendant benefits.

The U.S. Pat. No. 2,854,836 granted Oct. 7, 1958 to J. L. Morris had for its purpose the increasing of the inside space within the hook without increasing the outside overall dimensions, and this was accomplished by flattening the normally round wire of the known needles and forming the hook shape in other than a circular curve. Morris does not show or suggest redistributing the material to lower stress levels.

Various patents show the strengthening of needles hooks by using larger diameter wire flattened out into a roughly rectangular shape. Two such patents are U.S. Pat. No. 3,220,221 granted Nov. 30, 1965 to W. E. Sheeler, and U.S. Pat. No. 2,685,787 granted Aug. 10, 1954 to H. C. Noe. Sheeler uses a roughly rectangular shape of flattened-down round wire throughout the extent of the hook, and thus must have a greater mass of hook than we have to achieve the same reduced inner perimeter tensile stress that we achieve. Our needle of lesser mass contributes to decreased stress and wear of the knitting machine components and of the needle itself, and contributes to the possibility of higher machine speeds. Noe uses an even more massive needle hook construction than Sheeler.

Briefly described, our new invention is a machine knitting needle with a blade and a hook. The hook has a curved inside surface or perimeter, and a curved outside surface or perimeter. The hook wire cross-section is substantially wider at the inside periphery of the bend than are the standard known hook wires, at least in the portion of the hook which carries the greatest bending moment tensile loads which are imposed on the hook. The needle may be a pivoting latch needle, a spring-beard needle, or a sliding-latch needle, or any other needle using a needle hook in oscillating or reciprocating motion.

The invention as well as its many advantages will be further understood by reference to the following detailed description and drawings in which.

FIGS. 7 through 12 shown lateral cross-sections of typical hook wires of our invention.

Like parts in the various Figures are referred to by like numbers.

Figure 1:
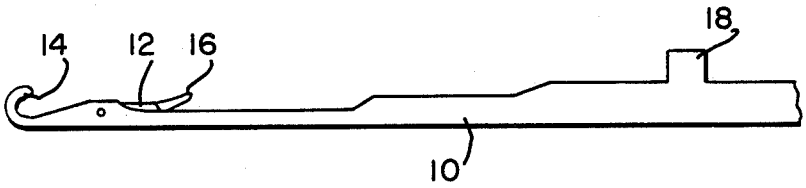
FIG. 1 is a side elevational view of a typical latch type knitting needle which may incorporate our invention.

Referring to the drawings and more particularly to FIG. 1, the machine knitting needle includes a blade 10, a pivotable latch 12, and a hook 14. During operation of the needle the latch 12 pivots many, many times from the latch open position as shown in FIG. 1 to the latch closed position where the nouget 16 of the latch 12 contacts the outside surface of the hook 14. The needle is reciprocated by the operation of a cam (not shown) which operates against the butt 18.

Figure 2:
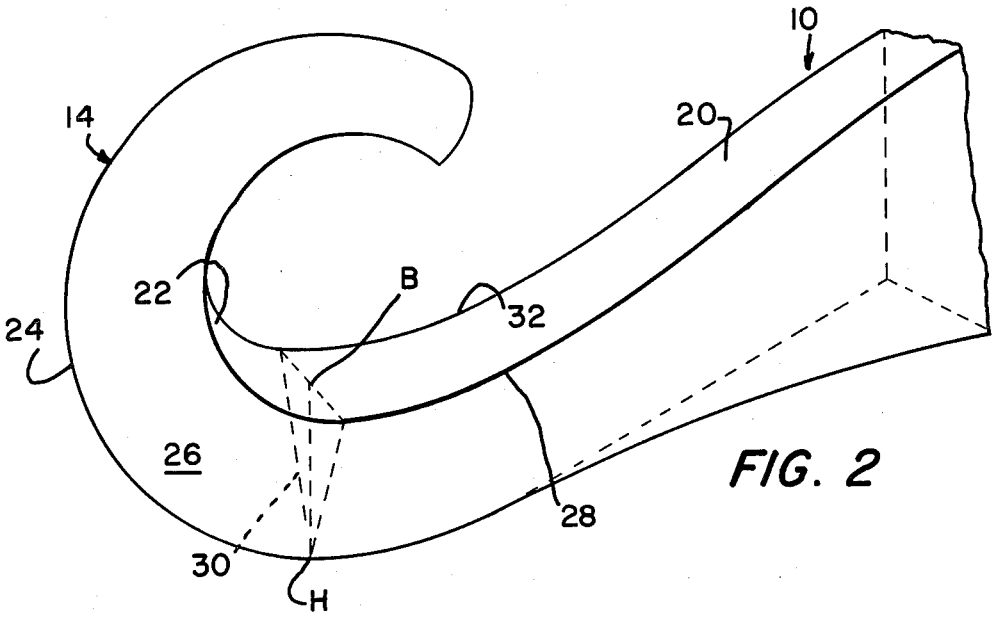
FIG. 2 is a perspective view of an enlarged scale of one preferred embodiment of our invention.

As shown more clearly in FIG. 2, the front area of the blade 10 tapers toward the hook 14 as shown by the numeral 20 and at the same time changes from a rectangular cross-sectional shape to a generally triangular cross-sectional shape with the points of the triangle being slightly rounded. The hook 14 includes a curved inside surface 22 and curved outside surface 24. A curved surface 26 extends from one lateral side 28 of the curved inside surface 22 to the curved outside surface 24. A curved surface 30 (see FIG. 2 and FIG. 7) of the hook extends from the lateral side 32 of the curved surface 22 to the outside curved surface 24.

Though the curved surfaces 22, 24, 26 and 30 are curved surfaces viewed in the longitudinal direction of the hook, the surfaces 22, 26 and 30 are relatively straight lines in lateral cross-section and the curved surface 24 is a rounded point in lateral cross-section. In the particular embodiment shown in FIG. 2, all of the lateral cross-sections along the length of the hook, at least from point (A) to point (C), (see FIG. 3) are substantially triangular in shape with the base of the triangle forming part of the curved inside surface 22 and the point of the triangle forming part of the curved outside surface 24. With this shape more of the hook wire than usual is located near the inside surface 22 so as to decrease the maximum stress levels generated in the hook when compared to conventional needle hooks. The larger portion toward the inside surface of the hook is where it should be in order to help withstand the constant stresses against the inside of the hook, thus resulting in longer knitting needle life.

Figure 11:
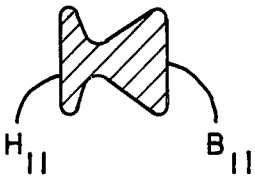
Figure 12:
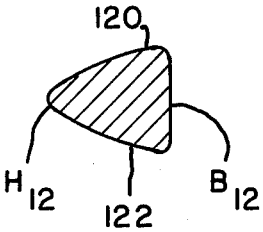

Lateral cross sections along the hook 14 might have slightly different shapes from the substantially triangular shapes shown in FIG. 2. For example, the lateral cross-section of the embodiment of FIG. 8 includes concave sides 80 and 82; the lateral cross-section of the embodiment of FIG. 12 includes convex sides 120 and 122; and the lateral cross-section of the embodiment of FIG. 11 is in the shape of an I-beam.

Figure 4:
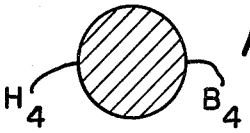
FIG. 4 PRIOR ART
FIGS. 4 through 6 show lateral cross-sections of prior art hook wires.
Figure 5:
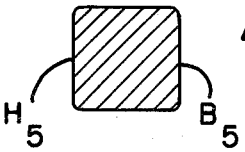
FIG. 5 PRIOR ART
Figure 6:
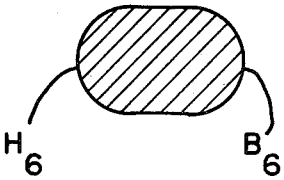
FIG. 6 PRIOR ART
Figure 7:
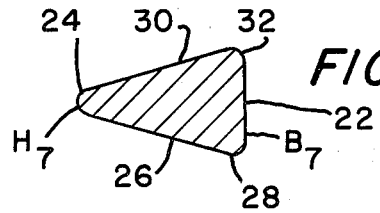
Figure 8:
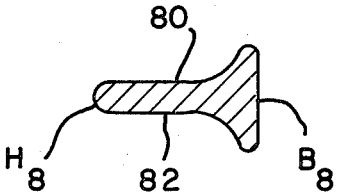
Figure 9:
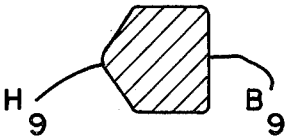
Figure 10:
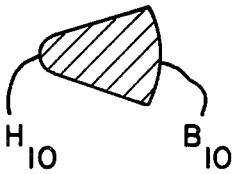

All of the hooks, both prior art and according to our invention, show the same width of hook wire and the same inside bend radius of the hook. FIGS. 5 and 6 show cross-sectional areas increased over that of the typical round hook wire of FIG. 4. The cross-sectional areas of the hook wires of our invention are no greater and may be less than the area of the wire FIG. 4, while still decreasing the maximum stress level of the hook wire under total loads equal to those experienced by the hook of FIG. 4.

Figure 3:
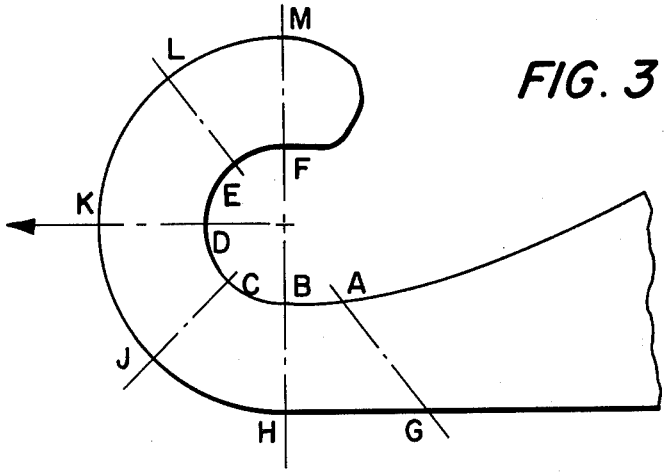
FIG. 3 shows a side elevational view of the hook of FIG. 2 which will be useful in explaining our invention.

In FIG. 3, with the needle motion being longitudinal and with the yarn pull being exerted parallel to the needle motion as shown at (P), the maximum stress in the needle hook will occur at point (B) on the inner periphery of the hook. Therefore, we reshape the typical round prior art hook wire into our preferred shapes at least from point (A) to point (C). We might carry the same cross-section all the way from before point (A) out to the free end of the hook. However, when there is a pivoting latch which must land on the exterior periphery of the free end of the hook near point (M) thousands of times per minute, we would not want that area shaped in cross-section like the point of a triangle. This could be very destructive to the latch in service. In the case of this pivoting latch, we would probably carry our form no further than from point (A) to point (E) and from point (E) to the free end of the hook we would shape the wire so that it gives a good seat to the pivoting latch. The particular shape of the latch seat is of no concern in this invention. It might be flat or rounded, convex or concave, or any other desired shape.

If either the needle motion or the direction of yarn pull is not in the direction indicated, the maximum stress would not be induced at point (B) but at some other point on the interior surface of the needle wire. We would locate the area of our wire re-forming or re-shaping to accommodate the actual conditions in service, to give the minimum possible maximum stress.

In all cases, the edges of the hook wire are at least slightly rounded so as not to damage the yarn beyond use and so as not to develop the stress raisers which invariably occur in sharp edges.

We claim:

1. A machine knitting needle having a blade and a hook, said hook having a curved inside surface and a curved outside surface, and shaped so that substantially more of the hook material is located nearer the curved inside surface of the hook than the curved outside surface of the hook so as to decrease the maximum stress levels generated in the hook when compared to conventional knitting needle hooks.

2. A machine knitting needle in accordance with claim 1 wherein at least a portion of the hook is substantially triangular in lateral cross-section.

3. A machine knitting needle in accordance with claim 2 wherein the sides of the substantially triangular lateral cross-section are concave.

4. A machine knitting needle in accordance with claim 2 wherein the sides of the substantially triangular lateral cross-section are convex.

5. A machine knitting needle in accordance with claim 1 wherein at least a portion of the hook is shaped like an I-beam in lateral cross-section.

* * * * *